US006268564B1

(12) United States Patent
Miyakoshi

(10) Patent No.: US 6,268,564 B1
(45) Date of Patent: Jul. 31, 2001

(54) CONNECTOR FIXING CONSTRUCTION OF CONNECTOR BRACKET

(75) Inventor: Koji Miyakoshi, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/271,207

(22) Filed: Mar. 17, 1999

(30) Foreign Application Priority Data

Mar. 18, 1998 (JP) ..... 10-068639

(51) Int. Cl.[7] ..... H01H 9/02

(52) U.S. Cl. ..... 174/58; 174/50; 439/701; 312/351; 220/533

(58) Field of Search ..... 174/58, 53, 57, 174/50; 220/3.2, 3.3, 3.94, 4.02, 532, 533, 552; 439/701; 312/351, 348.3; 206/708.707

(56) References Cited

U.S. PATENT DOCUMENTS 2,788,912 * 4/1957 Simonsen ..... 220/553
4,261,465 * 4/1981 Thomas ..... 206/708
4,577,773 * 3/1986 Bitel ..... 220/553
5,240,301 * 8/1993 Arnold ..... 296/39.2
5,299,688 * 4/1994 McKay et al. ..... 206/425
5,441,150 * 8/1995 Ma ..... 206/707
5,584,412 * 12/1996 Wang ..... 220/500
5,594,207 * 1/1997 Fabian et al. ..... 174/58
5,664,856 * 9/1997 Pacetti ..... 312/348.3

FOREIGN PATENT DOCUMENTS

2134884 * 8/1984 (GB) ..... 220/533
9117066 * 11/1991 (WO) ..... 220/533

* cited by examiner

*Primary Examiner*—Dean A. Reichard
*Assistant Examiner*—Dhiru R Patel
(74) *Attorney, Agent, or Firm*—Morgan, Lewis & Bockius LLP

(57) ABSTRACT

In a connector fixing construction of a connector bracket, there are provided a plurality of kinds of partition walls which can be suitably fixed within the connector bracket. A plurality of first fitting grooves for receiving and holding the various partition walls are formed in an inner peripheral surface of the connector bracket. A first lock projection is provided in the first fitting groove, and a second lock projection for engagement with the first lock projection is formed on each of opposite end surfaces of the partition wall. A connector lock for holding the connector is formed on each of the partition walls at a lower end portion thereof. A plurality of second fitting grooves are formed in each of opposite sides of the partition walls.

2 Claims, 6 Drawing Sheets

CONNECTOR FIXING CONSTRUCTION OF CONNECTOR BRACKET

BACKGROUND OF THE INVENTION

1. Field of the Invention

This invention relates to a connector fixing construction of a connector bracket, and more particularly to a connector fixing construction of a connector bracket, in which a plurality of kinds of partition walls are held within a bracket so that various connectors can be fixed within the bracket.

2. Description of the Related Art

Various connector fixing constructions of a connector bracket are already known. For example, there is known a connector fixing construction 51 of a connector bracket shown in FIGS. 5 and 6. The conventional connector bracket 52, shown in FIG. 5, includes partition walls 53 defining connector receiving chambers 54 to 58 for respectively receiving many kinds of connectors 61 to 65, and connector locks 59 provided adjacent respectively to the bottoms of the connector receiving chambers 54 to 58 for holding the connectors 61 to 65, respectively.

In the above connector fixing construction 51 of the connector bracket, when five kinds of connectors 61 to 65 are fitted respectively into the connector receiving chambers 54 to 58 from the bottom side of the connector bracket 52, these connectors are locked by the connector locks 59, respectively.

Thus, in the conventional connector fixing construction 51 of the connector bracket, many kinds of connectors 61 to 65 can be received and held within the connector bracket 52, and therefore the overall construction can be made compact as compared with the case where the connectors are mounted separately.

There is no problem with the above conventional connector fixing construction 51 of the connector bracket if the kinds and number of connectors to be received and held within the connector bracket are fixed. However, in many cases, the kinds and number of connectors are changed when the specification is changed or when the connector bracket is used in another kind of car. Therefore, the conventional connector bracket 52, in which the connector receiving chambers 54 to 58 are formed by the fixed partition walls 53, could not deal with such change, and therefore is inferior in versatility.

SUMMARY OF THE INVENTION

With the above problem in view, it is an object of this invention to provide a connector fixing construction of a connector bracket in which even if the kinds and number of connectors to be used are changed, this change can be dealt with.

In order to achieve the above object, according to the present invention, there is provided a connector fixing construction comprising: a connector bracket having a plurality of first fitting grooves formed in an inner peripheral surface thereof, the first fitting grooves extending vertically; and a plurality of kinds of partition walls for being fitted and held in the fitting grooves, wherein each of the partition walls is fitted in desired opposed ones of the first fitting grooves so that a plurality of connectors are fixed in their respective predetermined positions within the connector bracket.

In the above connector fixing construction of the connector bracket, the plurality of first fitting grooves are formed in the inner peripheral surface of the connector bracket, and extend vertically, and there are provided the plurality of kinds of partition walls for being fitted and held in the fitting grooves; and each of the partition walls is fitted in the desired opposed first fitting grooves so that the plurality of connectors can be fixed in their respective predetermined positions within the connector bracket. Therefore, even if the kinds and number of connectors to be used are changed, connector receiving chambers for respectively receiving the connectors can be formed. Therefore, there can be obtained the connector bracket having excellent versatility.

DETAILED DESCRIPTION OF THE PREFERRED EMBODIMENT

Figure 1:
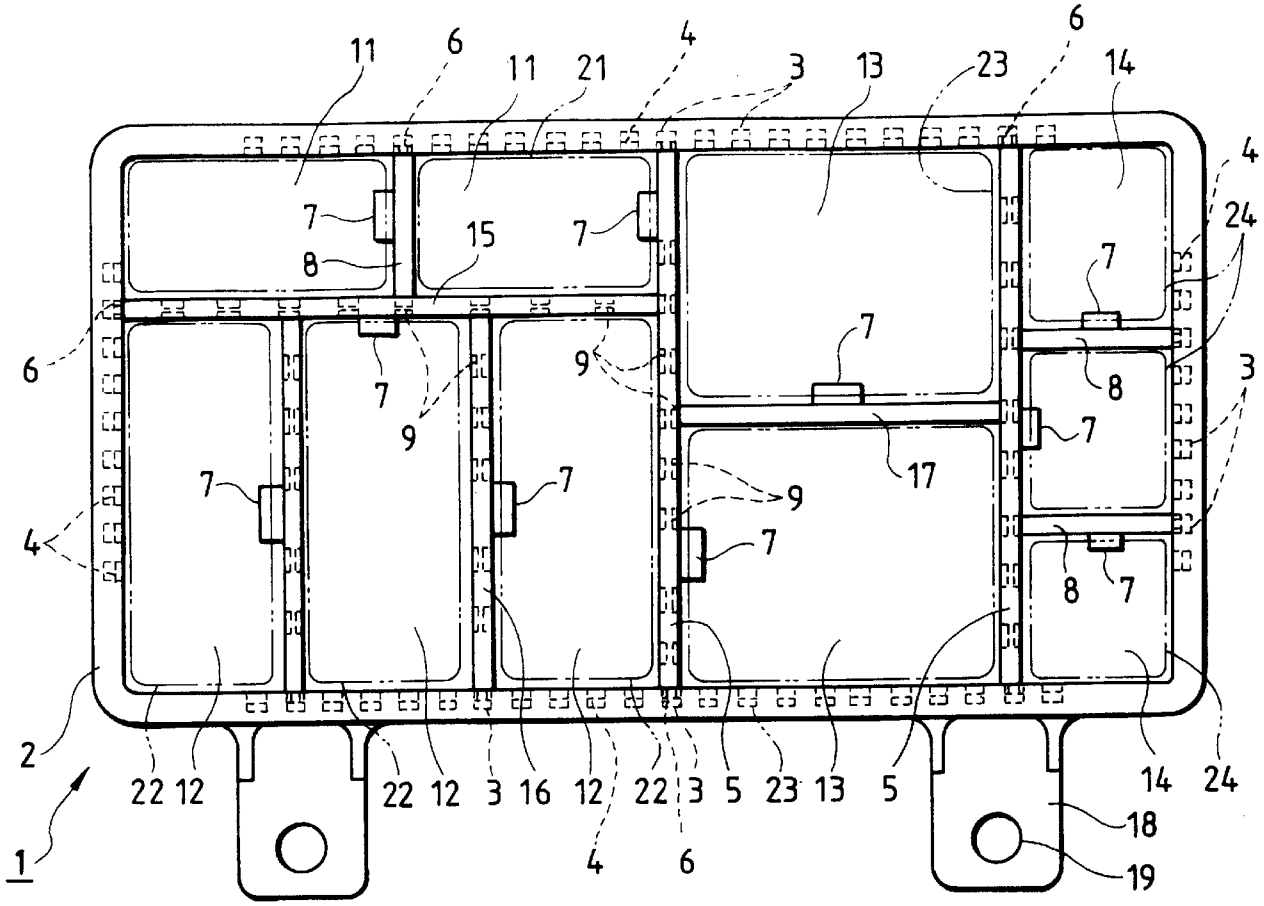
FIG. 1 is a plan view of a preferred embodiment of a connector fixing construction of a connector bracket of the invention.

A preferred embodiment of a connector fixing construction of a connector bracket of the invention will now be described in detail with reference to FIGS. 1 to 4. FIG. 1 is a plan view of the preferred embodiment of the connector fixing construction of the connector bracket of the invention, FIG. 2 is a perspective view of the connector bracket in FIG. 1, FIGS. 3(*a*) and 3(*b*) are perspective views showing partition walls in FIG. 1, and FIG. 4 is a perspective view showing a first fitting groove and an end surface of the partition wall in FIG. 1.

Figure 2:
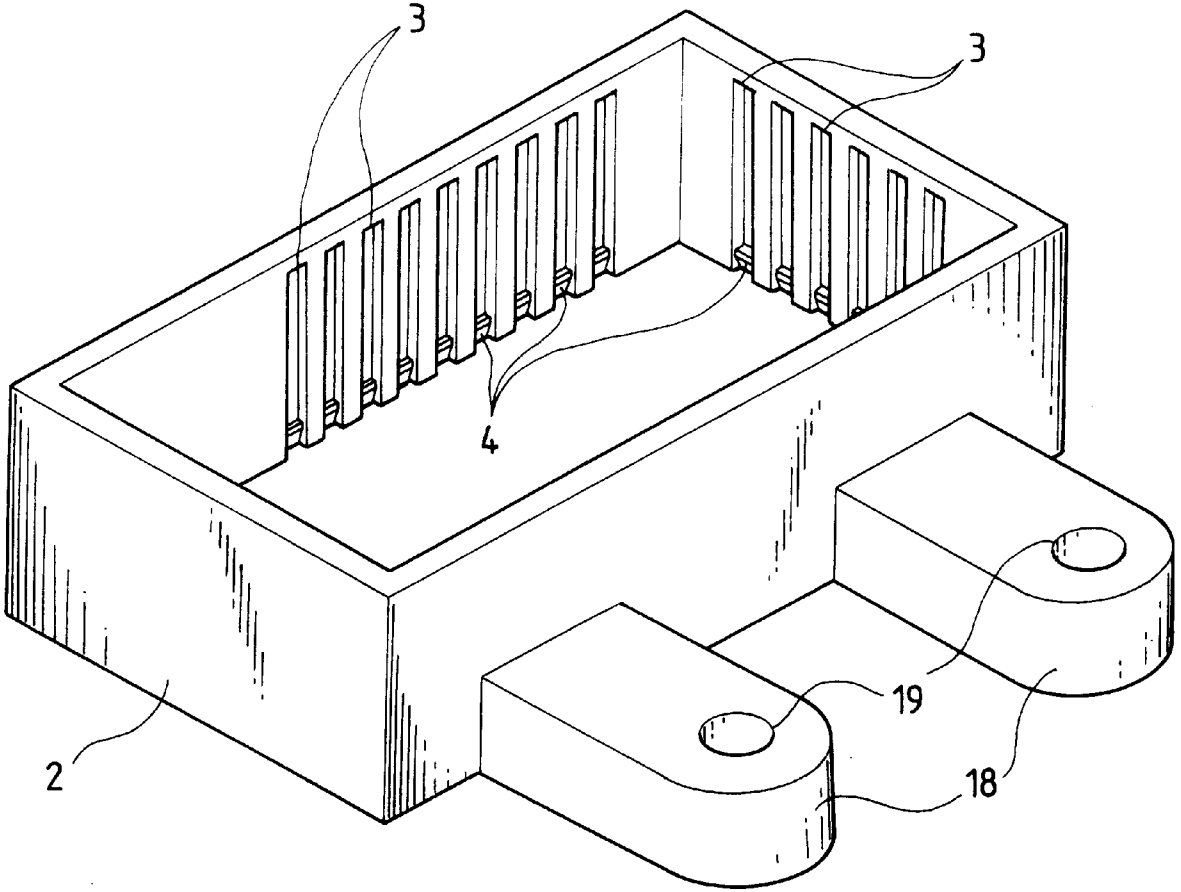
FIG. 2 is a perspective view of the connector bracket in FIG. 1.
Figure 3A:
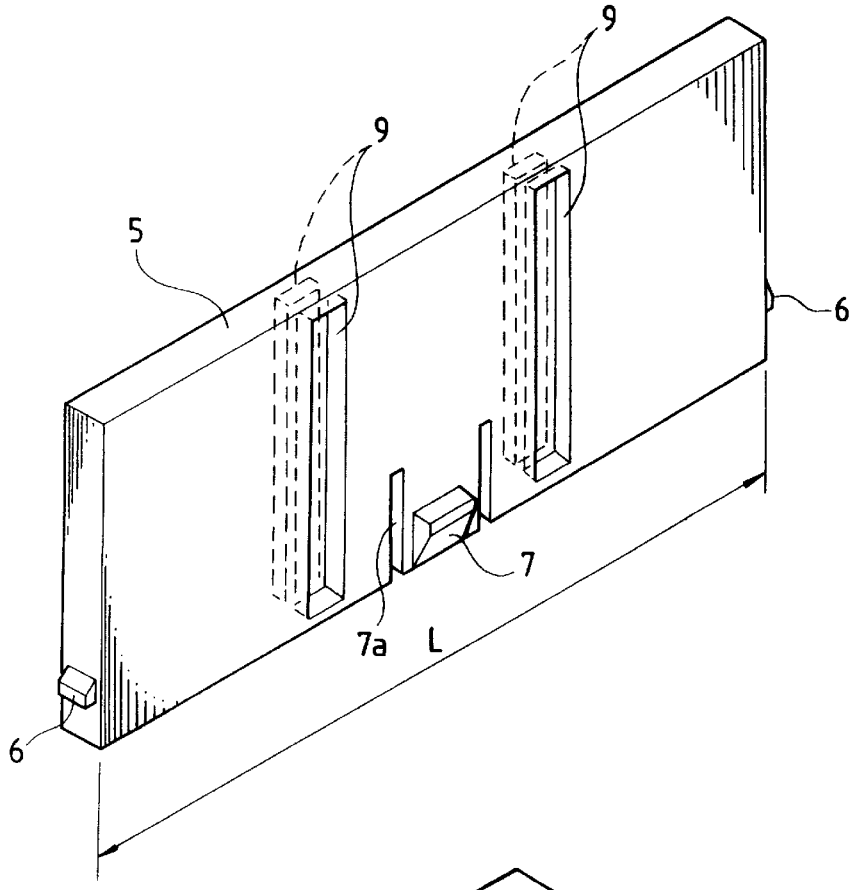
FIGS. 3(*a*) and 3(*b*) are perspective views showing partition walls in FIG. 1.
Figure 3B:
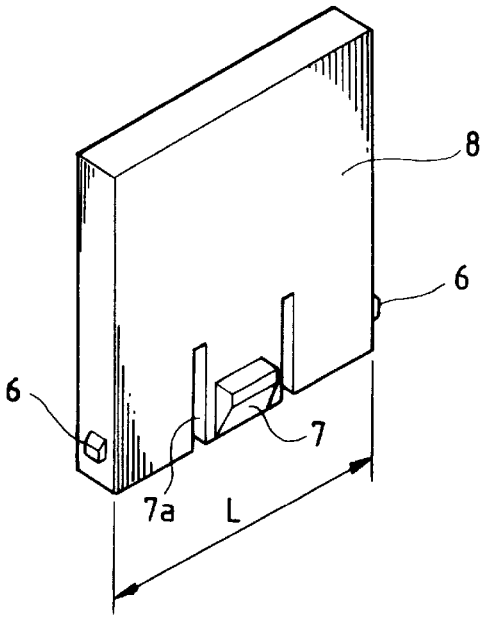
Figure 4:
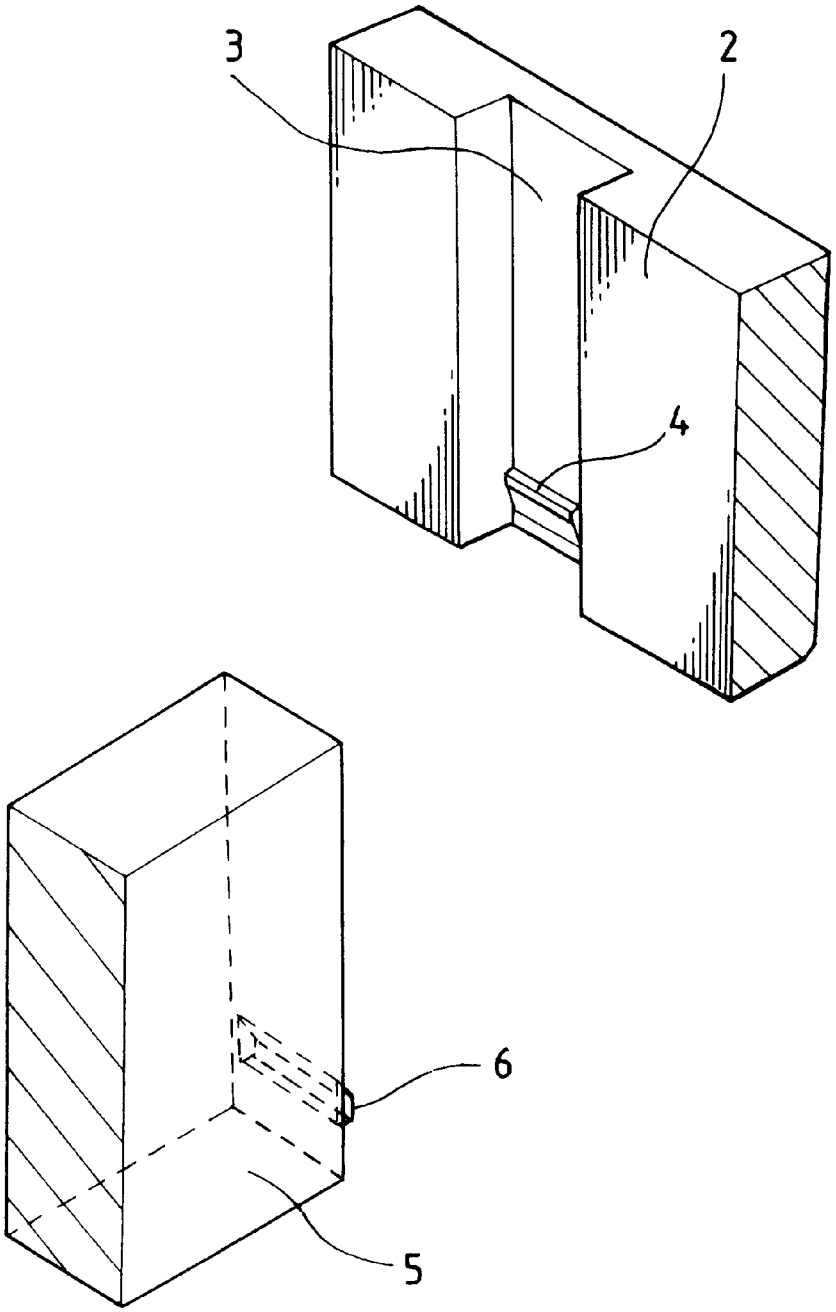
FIG. 4 is a perspective view showing a first lock projection and a second lock projection in FIG. 1.
Figure 5:
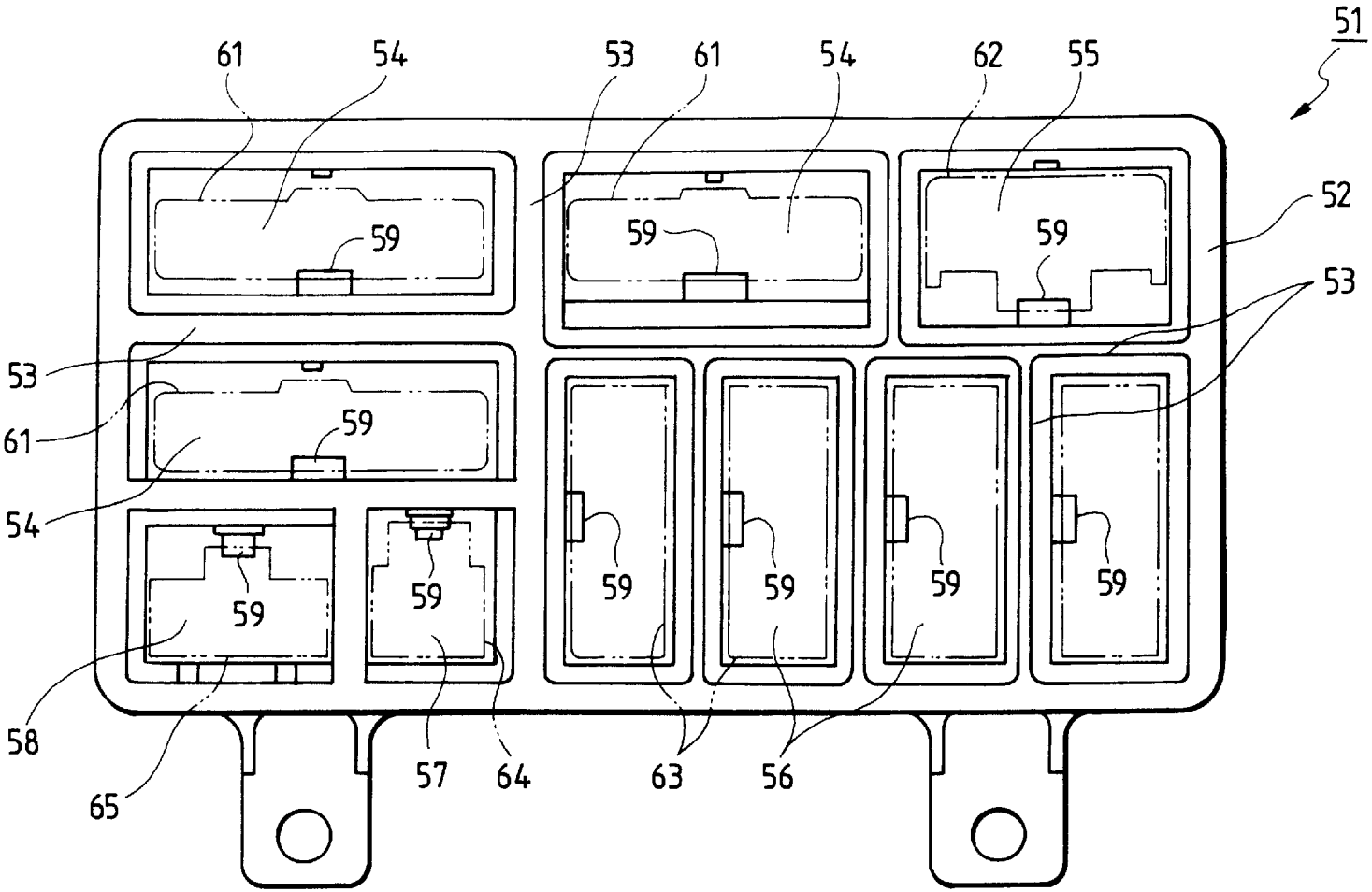
FIG.5 PRIOR ART
FIG. 5 is a plan view showing a conventional connector fixing construction of a connector bracket.
Figure 6:
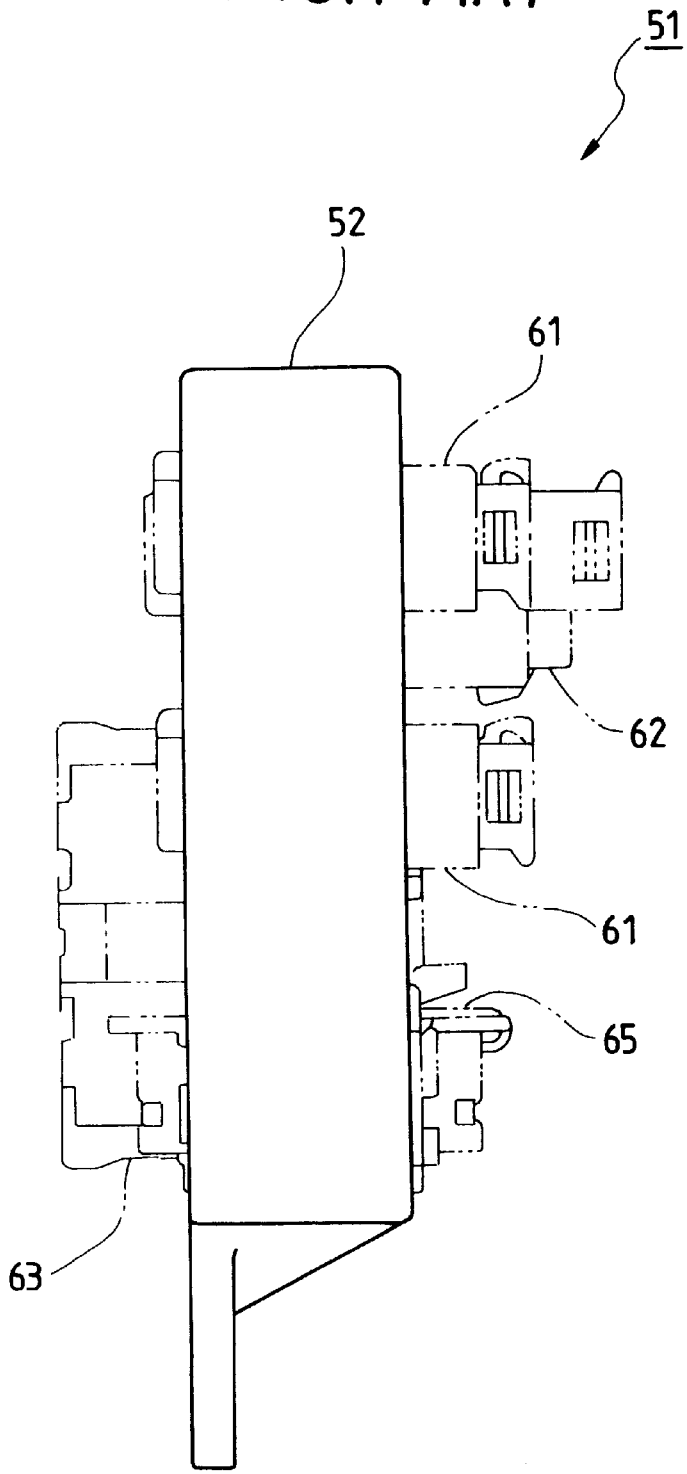
FIG. 6 PRIOR ART
FIG. 6 is a side-elevational view of the connector bracket in FIG. 5.

As shown in FIGS. 1 to 3(*b*), the connector bracket 2, having the connector fixing construction 1, is made, for example, of a synthetic resin, and connectors 21, 22, 23 and 24 are received and fixed within the connector bracket 2. A plurality of first fitting grooves 3 are formed in an inner peripheral surface of the connector bracket 2, and extend vertically (that is, in the direction of the height thereof). A plurality of kinds of partition walls (described later) can be fitted at their ends in the first fitting grooves 3. A first lock projection 4 for retaining the partition wall is formed at a lower end portion of each first fitting groove 3 (see FIG. 2).

There are provided the plurality of kinds of partition walls of different widths L, that is, the large-size partition walls 5, the medium-size partition walls 15, 16 and 17, and the small-size partition walls 8 (see FIGS. 3(*a*) and 3(*b*)). These partition walls can be suitably mounted within the connector bracket 2. A second lock projection 6 for engagement with the first lock projection 4 is formed on a lower end portion of each of opposite side end surfaces of each of the partition walls.

A connector lock 7 for holding the connectors 21, 22, 23, 24 is formed at a lower end portion of each of the partition walls 5, 8, 15, 16 and 17, and is disposed centrally of the length thereof. Slits 7*a* are formed in the partition wall, and are disposed respectively on opposite sides of the connector lock 7 so that that portion of the partition wall, having the connector lock 7, can be easily elastically deformed.

Second fitting grooves 9 are formed in each of the opposite sides (faces) of each of the partition walls 5, 15, 16 and 17, and extend vertically. The second fitting grooves 9 enable the interior of the connector bracket to be divided into many sections by the partition walls. Although the first fitting grooves 3 extend to the bottom of the connector bracket 2, the second fitting grooves 9 do not extend to the lower edge of the partition wall 5, 15, 16 and 17.

As shown in FIGS. 2, 3(*a*) and 3(*b*), the upper ends of the first and second fitting grooves 3 and 9 are not open upwardly, but are closed. Mounting brackets 18 each having a mounting hole 19 are formed integrally on the connector bracket 2, and the connector bracket 2 can be easily mounted on a vehicle body or the like through these mounting brackets 18.

In the above connector fixing construction 1 of the connector bracket, each partition wall 5 is first fitted into the desired first fitting grooves 3 from the lower side of the connector bracket 2, so that the second lock projections 6 are retainingly engaged respectively with the corresponding first lock projections 4, thereby fixing the partition wall 5 to the connector bracket 2. Then, the partition wall 17 is fitted in the second fitting grooves 9 in the partition walls 5 as shown in FIG. 1, so that the partition wall 17 is held on the partition walls 5 since the second fitting grooves 9 have the closed upper and lower ends. As a result, there is formed a connector receiving chamber 13 for receiving the large-size connector 23.

When each partition wall 8 is held in the desired first and second fitting grooves 3 and 9, there are formed connector receiving chambers 14 for receiving the small-size connectors 24, respectively. Further, when the partition walls 8, 15 and 16 are held in the desired first and second fitting grooves 3 and 9, connector receiving chambers 11 for respectively receiving the medium-size connectors 21, as well as connector receiving chambers 12 for respectively receiving the medium-size connectors 22, are formed. Then, the various connectors 21 to 24 are inserted respectively into the connector receiving chambers 11 to 14 from the lower side of the connector bracket 2, and are held by the connector locks 7.

As described above, in the connector fixing construction of the connector bracket of this embodiment, there are provided the plurality of kinds of partition walls 5, 8, 15, 16 and 17 which can be suitably mounted within the connector bracket 2, and the plurality of first fitting grooves 3, capable of holding the partition walls, are formed in the inner peripheral surface of the connector bracket 2. The second fitting grooves 9 for enabling the interior of the connector bracket to be divided into many sections are formed in the opposite sides (faces) of the partition walls 5, 15, 16 and 17.

Therefore, there can be formed the connector receiving chambers 11 to 14 corresponding to the various connectors 21 to 24 of difference shapes. Therefore, there can be obtained the connector bracket having excellent versatility.

The first lock projection 4 is formed in each first fitting groove 3, and the second lock projections 6 are formed on each partition wall 5, 8, 15, 16, 17, and the connector lock 7 for holding the connector 21, 22, 23, 24 is formed on the partition wall 5, 8, 15, 16 and 17 at its lower end portion. Therefore, the various partition walls 5, 8, 15, 16 and 17 and the various connectors 21 to 24 can be positively fixed within the connector bracket 2, and there can be obtained the connector bracket 2 of high reliability.

The connector fixing construction of the connector bracket of the invention is not limited to the above embodiment, but various modifications can be made. For example, in the above embodiment, although one connector lock 7 is formed on the central portion of the lower end portion of each partition wall, the connector lock 7 does not always need to be provided at the central portion, and also a plurality of connector locks may be provided in the case of using a large-size connector.

As described above, in the connector fixing construction of the connector bracket of the present invention, the plurality of first fitting grooves are formed in the inner peripheral surface of the connector bracket, and extend vertically, and there are provided the plurality of kinds of partition walls for being fitted and held in the fitting grooves, and each of the partition walls is fitted in the desired opposed first fitting grooves so that the plurality of connectors can be fixed in their respective predetermined positions within the connector bracket.

Therefore, even if the kinds and number of connectors to be used are changed, the connector receiving chambers for respectively receiving the connectors can be formed. Therefore, there can be obtained the connector bracket having excellent versatility.

The plurality of second fitting grooves for enabling the interior of the connector bracket to be divided into many sections are formed in each of the opposite sides of the partition wall, the second fitting grooves extending vertically. The first lock projection is provided in the first fitting groove, and the second lock projection for engagement with the first lock projection is formed on each of the opposite end surfaces of the partition wall.

Therefore, even if the kinds and number of connectors to be used are changed in a wider range, the connector receiving chambers for respectively receiving the connectors can be formed, and the partition walls and the connectors can be positively held. Therefore, there can be obtained the connector bracket having more excellent versatility and high reliability.

What is claimed is:

1. A connector fixing structure comprising:

a connector bracket having a plurality of first fitting grooves formed in an inner peripheral surface thereof, said first fitting grooves extending vertically; and a plurality of kinds of partition walls for being fitted and held in said first fitting grooves, wherein each of said partition walls is fitted in desired opposed ones of said first fitting grooves so that a plurality of connectors are fixed in their respective predetermined positions within said connector bracket; and a plurality of second fitting grooves for enabling an interior of said connector bracket to be divided into many sections are formed in each of opposite side surfaces of each of said partition walls, said second fitting grooves extending vertically and each having closed upper and lower ends.

2. A connector fixing structure comprising:

a connector bracket having a plurality of first fitting grooves formed in an inner peripheral surface thereof, said first fitting grooves extending vertically; and a plurality of kinds of partition walls for being fitted and held in said first fitting grooves, wherein each of said partition walls is fitted in desired opposed ones of said first fitting grooves so that a plurality of connectors are fixed in their respective predetermined positions within said connector bracket; and wherein a first lock projection is formed in each of said first fitting grooves, and a second lock projection for engagement with said first lock projection is formed on each of opposite end surfaces of each of said partition walls.

* * * * *